US006425153B1

(12) United States Patent
Reswick

(10) Patent No.: US 6,425,153 B1
(45) Date of Patent: Jul. 30, 2002

(54) SUPPORT CUSHION

(76) Inventor: James B. Reswick, 1003 Dead Run Dr., McLean, VA (US) 22101-2120

( * ) Notice: Subject to any disclaimer, the term of this patent is extended or adjusted under 35 U.S.C. 154(b) by 0 days.

(21) Appl. No.: 09/235,558

(22) Filed: Jan. 21, 1999

Related U.S. Application Data

(60) Provisional application No. 60/072,072, filed on Jan. 21, 1998.

(51) Int. Cl.[7] ..... A47C 27/20; A47C 7/20

(52) U.S. Cl. ..... 5/655.9; 5/718; 297/452.53

(58) Field of Search ..... 5/655.9, 740, 953, 5/643, 653, 718, 719; 297/452.28, 452.23, 452.54, 452.53

(56) References Cited

U.S. PATENT DOCUMENTS 2,980,167 A * 4/1961 Harris et al. ..... 267/143
2,980,168 A * 4/1961 Ross ..... 5/246
3,049,730 A * 8/1962 Wall et al. ..... 5/655.9 X
3,069,701 A * 12/1962 Mcinerney ..... 5/654.1
3,142,515 A * 7/1964 Wall et al. ..... 297/452.53 X
3,210,781 A * 10/1965 Pollock ..... 5/718
3,252,735 A * 5/1966 Smith, Jr. ..... 297/452.53
3,325,834 A * 6/1967 Lovette et al. ..... 5/718 X
3,353,869 A * 11/1967 Getz et al. ..... 297/452.54 X
3,393,012 A * 7/1968 Chancellor, Jr. ..... 5/653 X
3,529,866 A * 9/1970 Getz ..... 297/452.53
3,557,264 A * 1/1971 Getz et al. ..... 297/452.54 X
3,610,688 A * 10/1971 Arnold et al. ..... 297/452.53 X
3,656,807 A * 4/1972 Arida et al. ..... 297/452.53
3,669,498 A * 6/1972 Meyers et al. ..... 297/452.53
3,697,133 A * 10/1972 Wolofski ..... 297/452.53 X
3,716,875 A * 2/1973 Fehr ..... 297/452.53 X
3,790,150 A * 2/1974 Lippert ..... 297/452.1 X
3,840,269 A * 10/1974 Ambrose ..... 297/452.53 X
3,880,467 A * 4/1975 Tischler ..... 297/452.53
4,033,567 A * 7/1977 Lipfert ..... 297/452.54 X
4,283,864 A * 8/1981 Lipfert ..... 297/452.1 X
4,670,925 A * 6/1987 Carussi ..... 5/655.9
4,958,394 A * 9/1990 Urai et al. ..... 5/655.9 X
5,233,711 A * 8/1993 Urai et al. ..... 5/655.7
5,283,918 A * 2/1994 Weingartner et al. ..... 297/452.53 X
5,287,572 A * 2/1994 Strobel ..... 5/719
5,564,144 A * 10/1996 Weingartner et al. ..... 297/452.53 X

FOREIGN PATENT DOCUMENTS

EP 228350 A2 * 7/1987 ..... 5/718

* cited by examiner

*Primary Examiner*—Robert G. Santos
(74) *Attorney, Agent, or Firm*—Mattingly, Stanger & Malur, P.C.

(57) ABSTRACT

A cushion having a sitting surface is provided that includes a three dimensional system of rigid plastic levers used in combination with a foam cushioning material. Weight applied to the cushion is borne by the plastic levers. When sat on, the cushion conforms to the user's body and automatically shapes itself to uniformly distribute support pressure within each of four seat quadrants. As the body shifts in position, the cushion automatically reconfigures itself to maintain substantially uniform pressure distributions. Construction details and a method for low cost manufacture are presented.

10 Claims, 11 Drawing Sheets

SUPPORT CUSHION

CROSS-REFERENCE TO RELATED APPLICATIONS

This application claims priority under 35 U.S.C. §119(e) to my copending provisional application, Ser. No. 60/072,072, filed Jan. 21, 1998.

SEQUENCE LISTING

Not Applicable.

STATEMENT REGARDING FEDERALLY SPONSORED RESEARCH OR DEVELOPMENT

Not Applicable.

BACKGROUND OF THE INVENTION

This invention relates to support cushions, and in particular to a support cushion that includes a mechanical support system imbedded in foam cushioning material. The mechanical support cushion conforms to a user's body and maintains substantially uniform pressure distribution within each of a plurality of sections of the cushion. The invention as described herein relates to seat cushions used on chairs, and in particular on seats of wheelchairs. However, it will be appreciated that the support cushion can be readily adapted for use in any situation where it is desired to exert substantially uniform or balance pressures against a body resting thereon. For example, the support system can be used in beds, chairs back supports and the like.

In general, wheelchairs include a seat and backrest that are constructed from flexible material that easily folds when the wheelchair is collapsed. However, the flexible material of the seat and backrest does not provide optimum support or comfort for the occupant. Foam and air filled seat cushions and contoured universal backrests have been developed to provide improved support for individuals requiring special support, such as paraplegics or those having spinal deformities or muscular atrophy, but these seat cushions and backrests are difficult to adjust to accommodate specific needs and proportions of individual users and do not encourage proper control of body position. Users often over use their back muscles in efforts to maintain proper posture. Furthermore, wheelchair users and those confined to beds often become oversensitive to pressures against their skin and bodies so that it is desirable to develop a support cushion that exerts low pressures against a user's body and skin.

Support cushions have been developed that provide low pressures on a user's body. For example, U.S. Pat. No. 3,790,150, issued Feb. 5, 1974 to Lippert; U.S. Pat. No. 4,033,567, issued Jul. 5, 1977 to Lipfert; U.S. Pat. No. 4,283,864, issued Aug. 18, 1981 to Lipfert; and U.S. Pat. No. 4,484,778, issued Nov. 27, 1984 to Cousins et al., disclose various mechanical support systems that conform to the shape of the user's body and distribute pressure over user's body. However, such support cushions do not provide the necessary postural control and stability for persons such as active paraplegics and active wheelchair users.

Accordingly, it is desirable to develop a support cushion that not only conforms to the shape of the user's body, but also provides stabilizing forces that allow for postural control. Such a support cushion should provide a stable platform to permit improved control of body position and posture without overusing back muscles. Furthermore, such a support cushion must be durable and able to withstand extensive use for extended periods of time.

BRIEF SUMMARY OF THE INVENTION

Accordingly, it is an object of the present invention to provide a support cushion and method for making the same that conforms to the shape of the user's body, distributes support pressure and provides a stable support surface for a user.

These and other objects will become apparent to those skilled in the art in light of the following disclosure and accompanying drawings.

In accordance with the invention, generally stated, a support cushion is provided that includes an outer foam shell having a cavity formed therein; foam filling disposed in the cavity of the outer shell; and a mechanical support structure disposed in the cavity and imbedded in the foam filing that distributes pressure exerted on the cushion by a user. The density of the foam shell preferably is greater than the density of the foam filing. In the preferred embodiment, the foam filing is a low density soft urethane foam.

Another aspect of this invention includes a method for making a support cushion, including the steps of: placing a preformed foam shell having a top panel and sidewalls extending downwardly therefrom in a form having dimensions slightly greater than the peripheral dimensions of the top panel; placing a mechanical support structure on the top panel of the foam shell in a cavity defined by the top panel and sidewalls; pouring a foam filing mixture in the cavity of the outer shell so that the mechanical support structure is imbedded in the foam filing after the foam filing cures; placing a bottom panel over the mechanical support before the foam filing cures; and removing the cushion from the form after the foam filing cures.

Other objects and features will be apparent and in part pointed out hereinafter.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
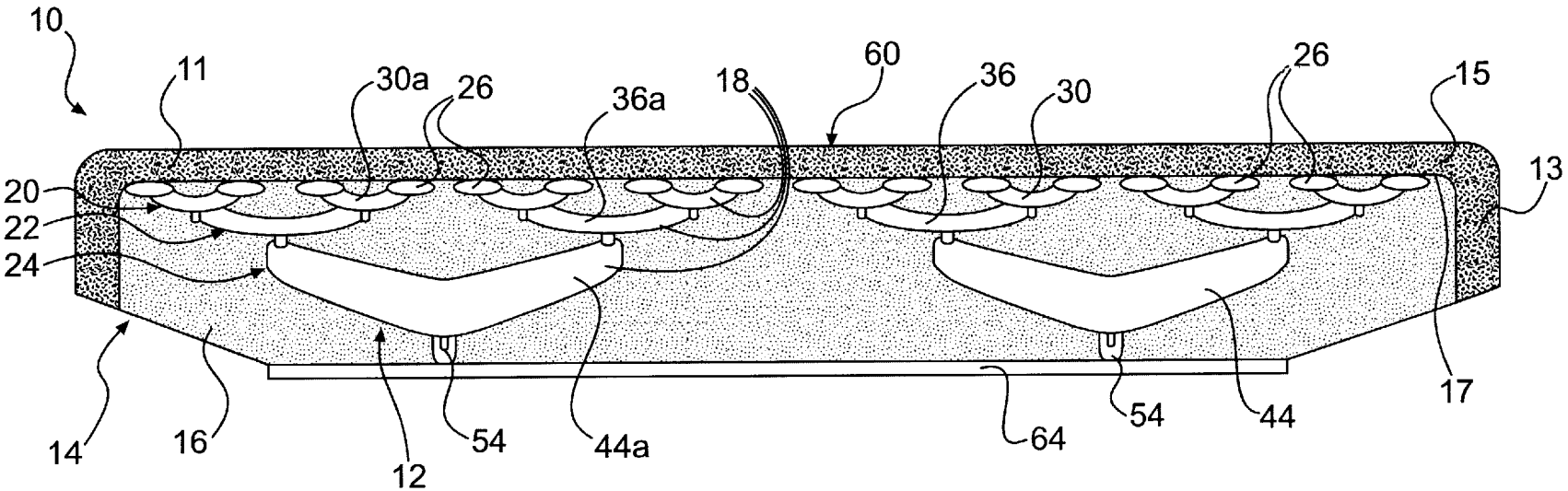
FIG. 1 is a cross-sectional view of the support cushion of the present invention.
Figure 10:
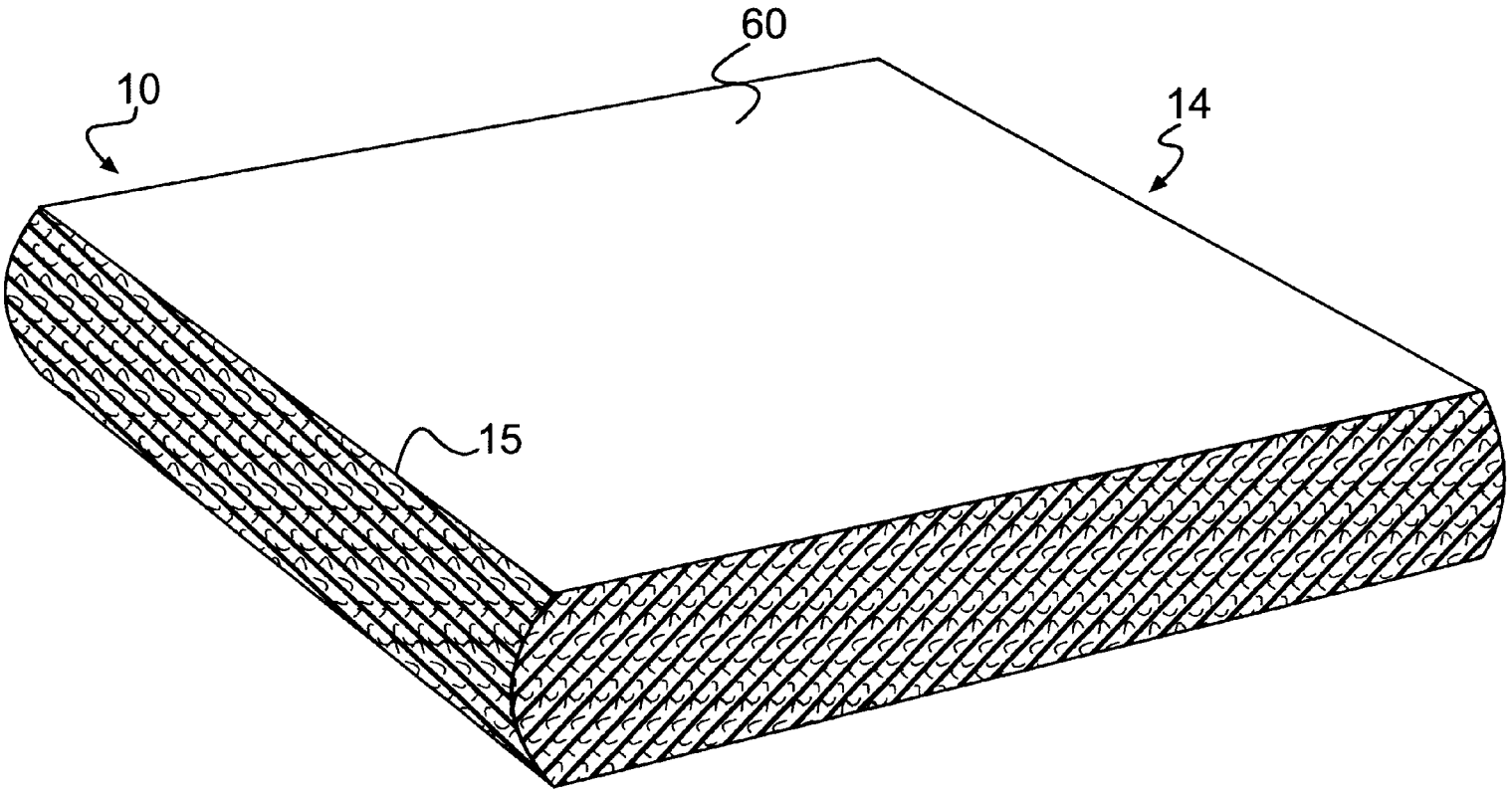
FIG. 10 is a perspective view of the support cushion.

Referring now to the drawings, and in particular to FIGS. 1 and 10; a support cushion is shown, referred to generally by reference number 10, that includes a mechanical support structure 12 imbedded in foam cushioning 14. The foam cushioning 14 preferably is constructed from a first foam cushioning material 15 and a second foam cushioning material 16. The first material 15 preferably is a medium density foam cover or shell. The shell 15 preferably is preformed, and includes a top panel 11 and sidewalls 13 extending downwardly from the outer periphery of the top panel so as to define a cavity 17 therebetween, with the top panel 11 and sidewalls 13 being integrally formed. The second material 16 preferably is a low density foam filing. As discussed below, the mechanical structure 12 is disposed in the cavity 17 of the outer shell 15, and foam filing 16 then is poured in the cavity 17 of the foam shell 14 upon assembly of the cushion 10. The foam cushion 14 supports the mechanical structure 12.

Figure 5:
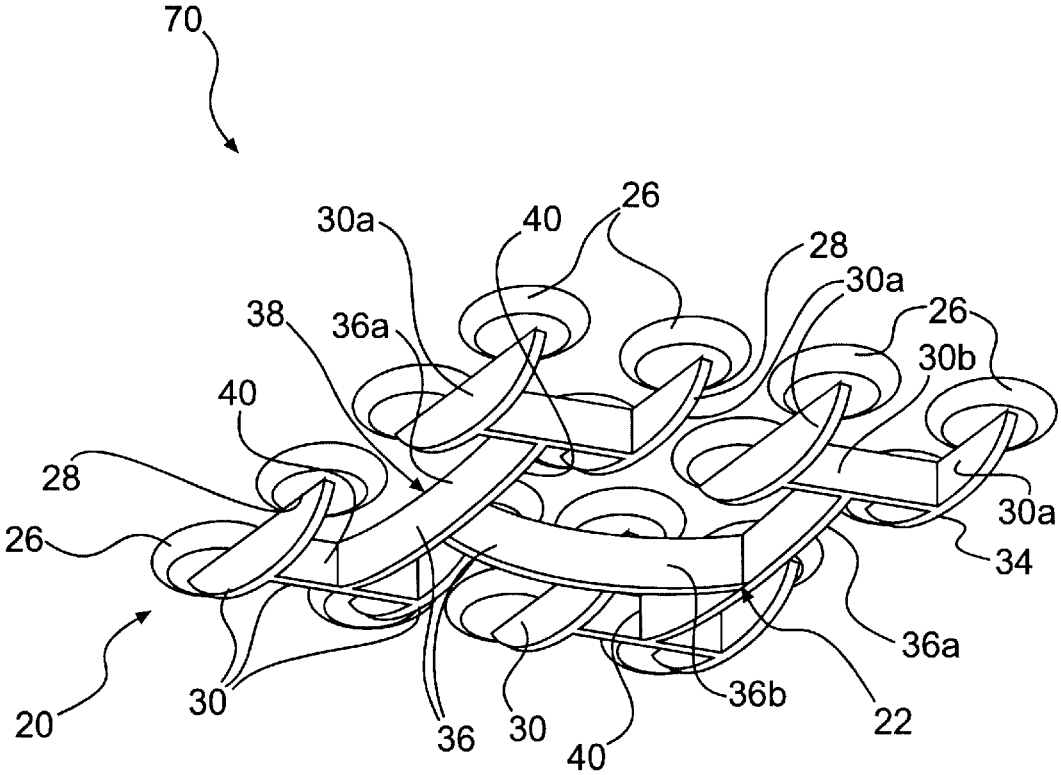
FIG. 5 is a perspective view of five "H-type" lever systems associated with the first and second tiers that are molded into a single unit with 16 "button" points of support.
Figure 6:
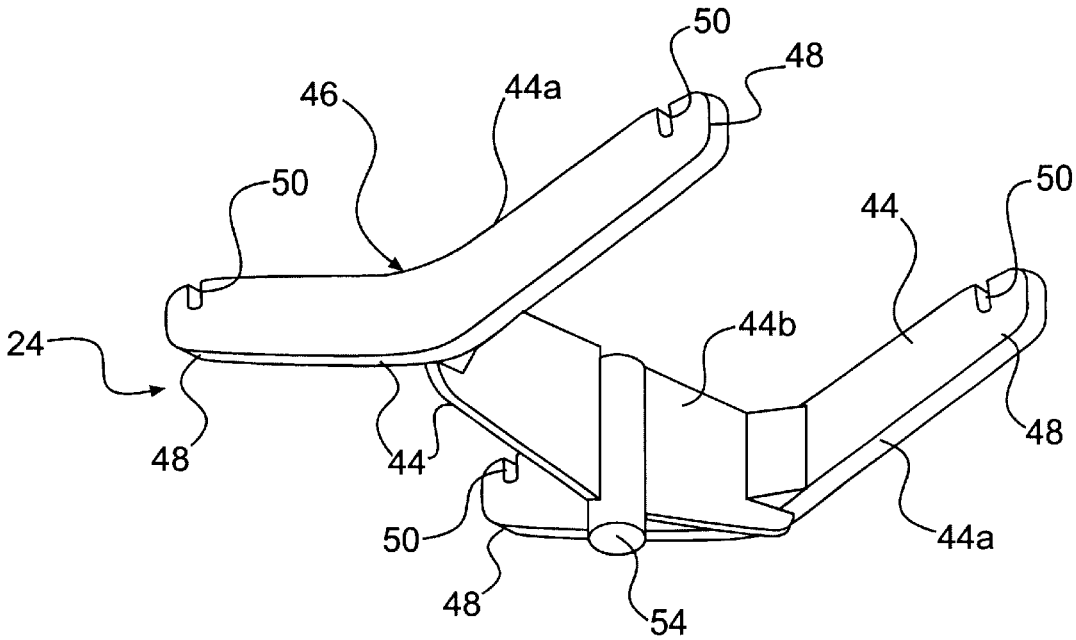
FIG. 6 is a perspective view of a third tier support lever.
Figure 7:
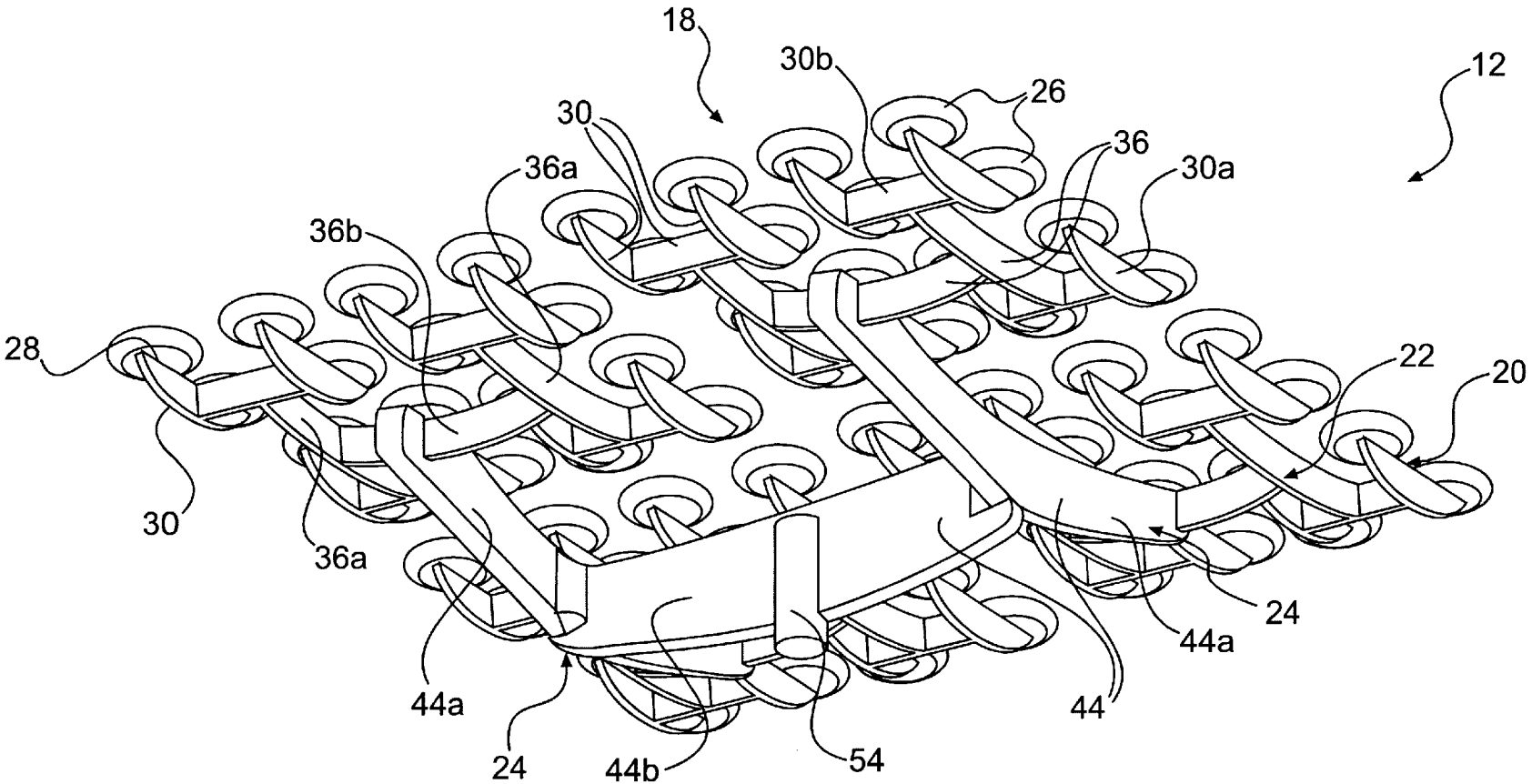
FIG. 7 is a perspective view of the first, second and third tier levers molded together with 64 button shaped points mounted on ends of lever arms associated with the first tier.

The support structure 12 preferably includes a three tiered lever system 18, having a first tier lever system 20 mounted on a second tier lever system 22 (FIGS. 5 and 7), and a third tier lever system 24 (FIGS. 6 and 7) on which the second tier lever system 22 rests (FIGS. 1 and 7). The support structure 12 also includes an array of button shaped support points 26 that are supported by ends 28 of lever arms 30 associated with the first tier system 20. More specifically, the first tier lever system 20 includes a plurality of lever arms 30 arranged in groupings 34, with each grouping 34 including a pair of lateral lever arms 30*a* connected at their midpoints by a transverse lever arm 30*b*. Lever arms 30*a* and 30*b* are referred to collectively as lever arms 30. As shown in FIGS. 5 and 7, lever arms 30*a* and 30*b* of each grouping 34 are disposed in a "H" configuration, with each grouping 34 having four support points 26 attached to ends 28 of levers 30*a* (FIG. 5).

The second tier system 22 includes a plurality of lever arms 36. Lever arms 36 are disposed in groupings 38, and each grouping 38 includes a pair of lateral lever arms 36*a* connected at their midpoints by a transverse lever arm 36*b*. Lever arms 36*a* and 36*b* are referred to collectively as lever arms 36. As shown in FIGS. 5 and 7, lever-arms 36*a* and 36*b* of each grouping 38 are disposed in a "H" configuration. As shown in FIG. 5, groupings 34 of the first tier system are secured to ends 40 of lever arms 36*a* such that each grouping 38 of the second tier system 22 has four groupings 34 of the first tier system 20 attached thereto.

The third tier system 24 includes a plurality of lever arms 44. The lever arms 44 are arranged in groupings 46, and each grouping 46 includes a pair of lateral lever arms 44*a* connected at their midpoints by a transverse lever arm 44*b*. Lever arms 44*a* and 44*b* are referred to collectively as lever arms 44. As shown in FIGS. 6 and 7, lever arms 44*a* and 44*b* of each grouping 46 are disposed in a "H" shaped configuration. Ends 48 of the levers 44*a* preferably have a notch 50 extending downwardly as shown in FIG. 6. The notch 50 is adapted to accommodate the middle lever 36*b* of the second tier groupings 34 so that each "H" shaped grouping 46 of the third tier supports four groupings 38 of the second tier 22 as shown in FIG. 7.

Figure 8:
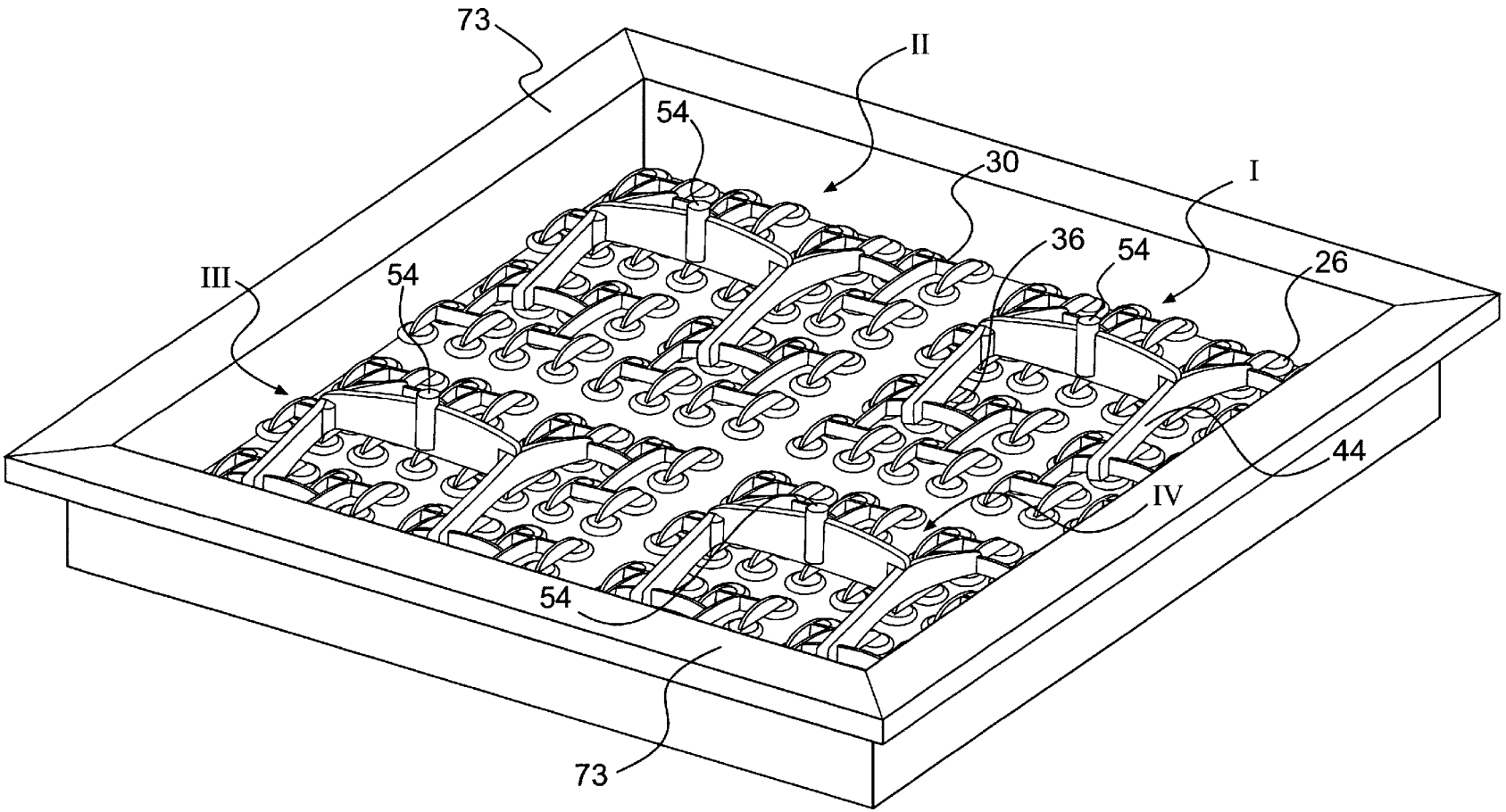
FIG. 8 is a photographic representation showing a complete assembly of the foam cover and mechanical support structure disposed within a form prior to pouring in the foam filing.

To form a seat cushion such as can be placed on a wheelchair seat or other seat, four third tier groupings 46 are employed as shown in FIG. 8. These four groupings 46 define four quadrants I, II, III and IV of the seat cushion. A support post 54 is secured to the middle lever 44*b* of each third tier 24 grouping 46 at a location corresponding to the fulcrum of that lever system. Thus, the support posts 54 define four distinct points of support for the seat cushion 10. When four third tier groupings 46 are used, sixteen second tier 22 groupings 34, sixty four first tier 20 groupings 34 and 256 support buttons 26 are employed in the mechanical support structure 12.

The support cushion 10 provides substantially uniform pressure distribution and, at the same time, provides improved stability for users resting against the cushion 10. When used as a seat cushion, the cushion 10 allows for better positioning of a user's pelvic area. The cushion 10 includes a support surface 60 that conforms to and supports the user's body. Body weight is carried by the three dimensional lever system 18 which conforms to the body and uniformly distributes tissue pressure within each of four seat quadrants I, II, III and IV. The mechanical support structure 12 is imbedded in plastic foam filing 16 which retains the levers 30*a*, 30*b*, 36*a*, 36*b*, 44*a*, 44*b* in position and provides improved stability.

In use, the internal mechanical support structure 12 shapes itself to produce substantially uniform pressure and, without substantial elastic deformation, supports the user's weight. The soft plastic foam filing 16 in which the support structure 12 is imbedded is not subjected to any substantial deformation; thus, the foam cushioning 14 produces minimal force reaction and escapes wear experienced by conventional foam cushions.

The preferred embodiment of the wheelchair cushion is approximately 2 ¾ inches in thickness, 16 ½ inches in width and 16 ½ inches in depth. The cushion 10 carries body weight to four support points associated with the support posts 54, with two support points associated with two posts 54 being, disposed under the user's pelvis and two support points associated with the other two posts 54 being disposed under the user's thighs. This "4-point" support provides a stable platform to permit good control of body position by users such as, for example, paraplegic wheelchair users who find that some conventional air or gel filled and foam cushions require them to overuse their back muscles to maintain posture. When wheelchair footrests are properly adjusted for thigh contact and the user is seated on the cushion 10, pressure ranges from 50 to 65 mmHg under the buttocks and from 40 to 50 mmHg under the thighs for a person of average weight.

Overall deflection (compression of the cushion 10) is approximately zero. As the surface 60 of the cushion 10 conforms to the shape of the user's body, areas of the cushion 10 that move downward are accompanied by areas that move upward. Thus, the foam matrix cushion 10 is not subjected to overall compression.

The underside of the cushion in the preferred embodiment is layered with a panel 64, preferably 13×13 inches of 3/16 inch plywood. The four points of support associated with the four support posts 54 form an 8×8 inch square on this panel 64 which rests on a wheelchair seat or other seat. The four support points on which the body weight is concentrated provide a very stable platform that many disabled persons, such as active paraplegics, find helps in control of their wheelchairs and relieves back muscles from having to stay balanced on conventional air, gel or soft foam cushions.

The cushion 10 is constructed from relatively inexpensive components. The mechanical support structure 12 preferably is constructed from plastic moldings so that all moving, weight bearing parts are made of strong, durable plastic. The plastic moldings and foam cushion 14 can be manufactured quickly at relatively minimal cost. The cushion 10 also is very durable and has a long life.

Figure 2:
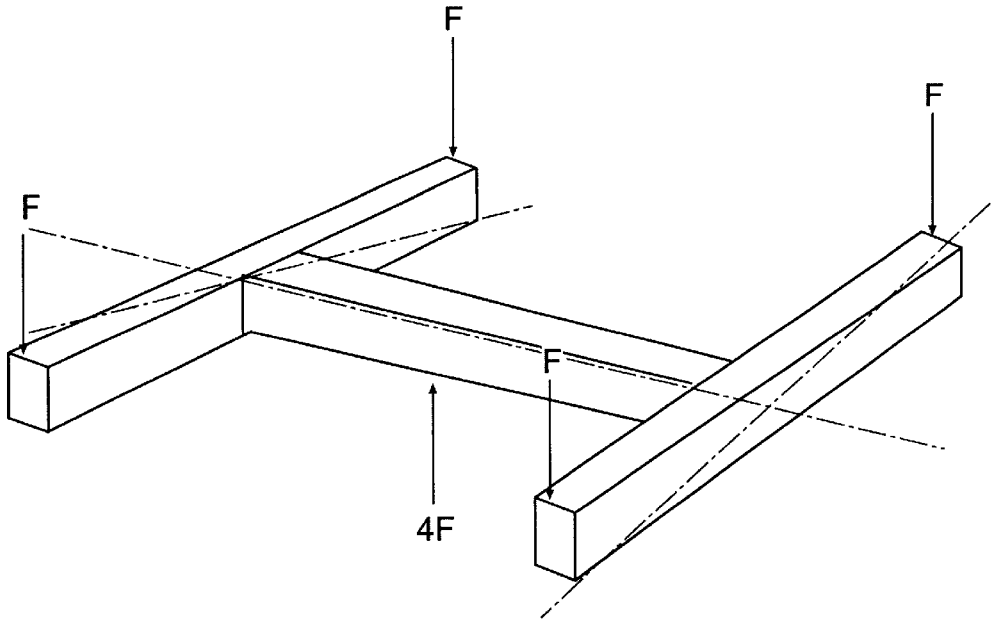
FIG. 2 is a perspective view of a "H" lever system with free bearings.

The imbedded supports structure 12 of the cushion 10 is based upon a complex system of levers including the first tier lever system 20, the second tier lever system 22 and the third tier lever system 24. It is known that when a lever is supported at its center (its fulcrum) and a force is applied at one end, an exactly equal force must be applied at the other end if the lever is to be in equilibrium (not move). When three levers are assembled, as shown in FIG. 2, in the form of an "H" with fulcrums equidistant from their ends, all lever arms are equal and any forces (points of support) that exist on the ends of the arms must also be equal. Four such "H" configurations can be placed at the ends of another larger "H" so that a system of 16 points of support, all with identical forces must result when in equilibrium. Additional "H" structures can be added until a large number of support points exist.

Figure 4:
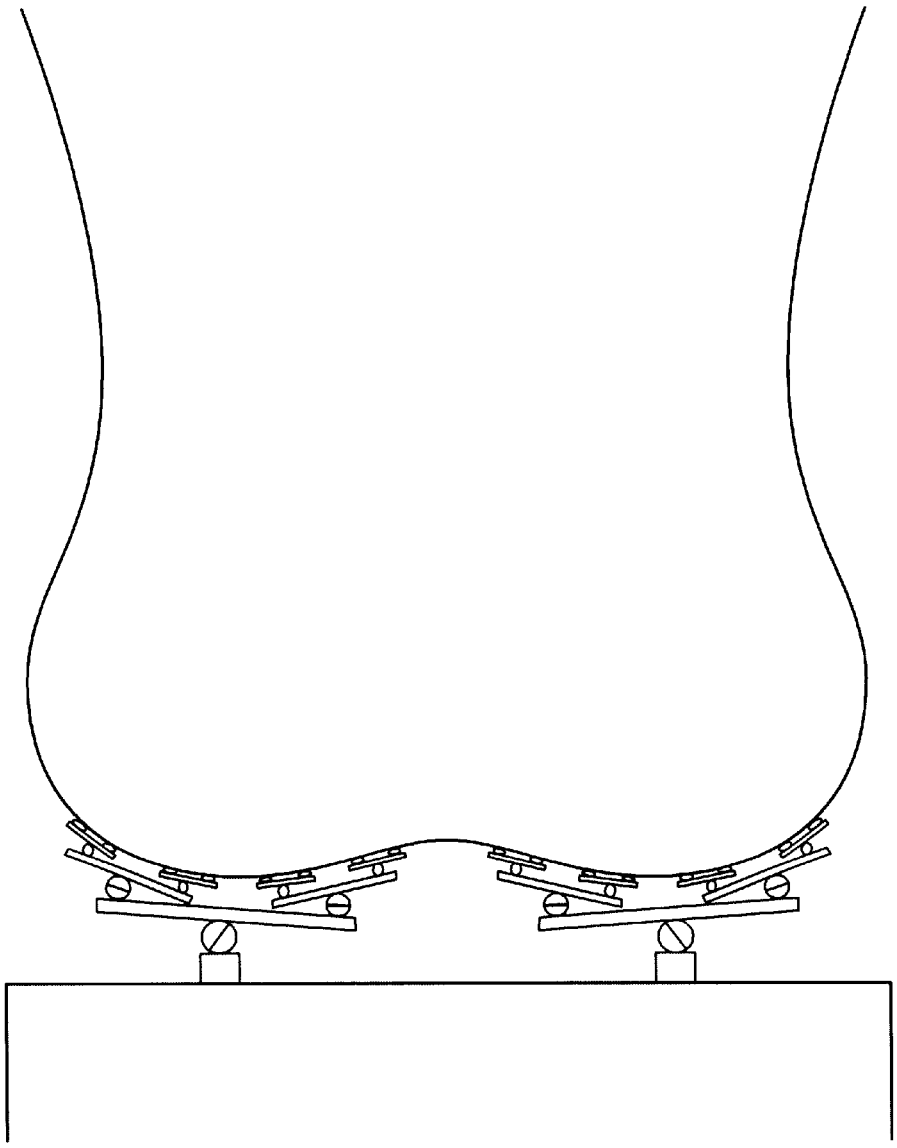
FIG. 4 is a schematic view of a three tiered lever support system, showing the levers adapting to support a user.

FIG. 4 shows schematically how such a system supporting the human body might appear. A cushion 16 inches by 16 inches with 1 inch spacing of the support points would have 256 support points. This is a useful size and because 256 is equal to 2 raised to the 8th power, it leads to a convenient 3 dimensional array of "H" equivalents.

Figure 3:
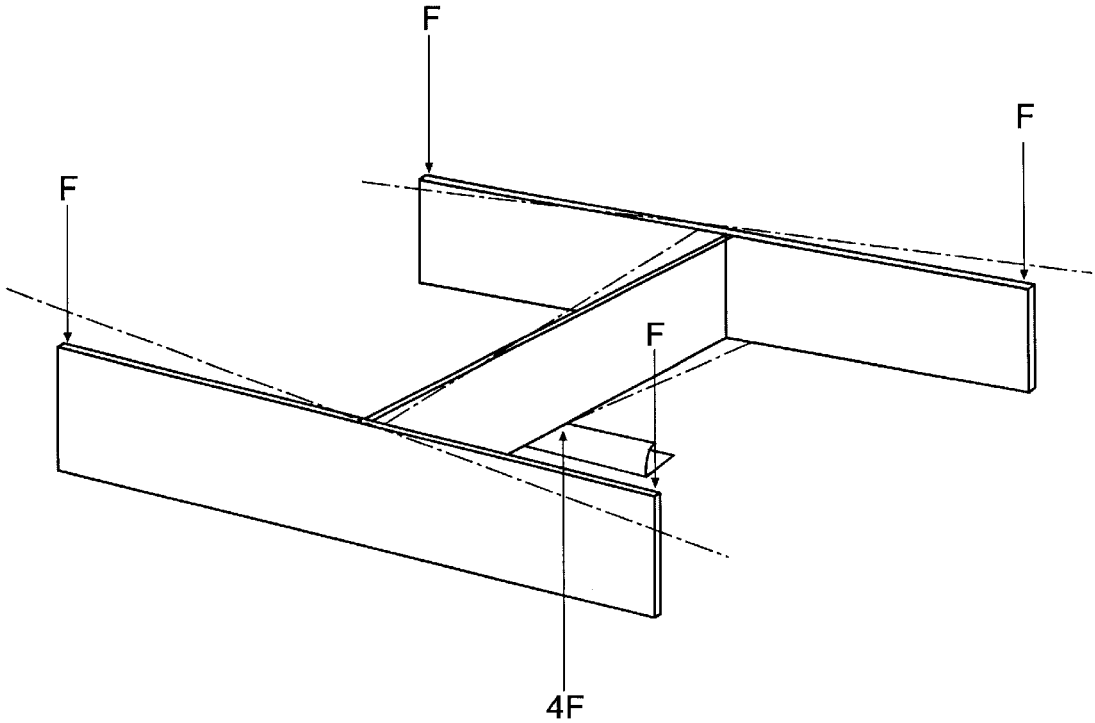
FIG. 3 is a perspective view of a "H" lever system substantially equivalent to that shown in FIG. 2 except the system employs wider and thinner beams that permit twisting at their ends with negligible bending.

In the first prototype cushion, the "H" structures were created by simply laying round dowels on top of each other. These cushions, made of dowels and urethane foam, worked well but involved a great deal of hand labor. In order to make prototypes that would show how the cushions could be made in high production at low cost, a different approach to the provision of bearings as fulcrums for the levers was devised as shown in FIG. 3. By using an integral unit composed of very thin beams, the desired "rocking" can be obtained through the low resistance to torsion (as compared to bending) of a very thin but wide beam. This approach allows a number of "H" elements to be integrated into a single part that can be made cheaply from molded plastic. The rounded buttons 26 preferably are ⅝ inch in diameter, and molded as part of the plastic lever systems 20, 22, 24 that form the sitting surface.

In the preferred embodiment of the cushion 10 as used for a wheelchair seat cushion, the foam outer layer 15 preferably is ½ inch in thickness, and lies between the body and the one inch array of 256 rounded support "button." A non paraplegic person does not feel individual buttons but senses only a comfortable "soft" cushion (see FIG. 1) As discussed above, a square array of 256 button shaped support points 26 are mounted at the ends 28 of the first tier levers 30 on a one inch grid that results in a sitting surface 60 approximately 16×16 inches. The sitting surface is produced by an array of sixteen identical plastic units 70, with each unit 70 including one second tier grouping 38, four first tier groupings 34 and sixteen support buttons 26 (FIG. 5). Each plastic unit 70 is an integral unit that covers an area four inches by four inches and combines five "H" functions in a single molding (i.e., four first tier groupings 34 and one second tier grouping 38). Sixteen units 70 are required to cover the complete cushion seating area for a wheelchair seat. As discussed above, each second tier grouping 38 rests in one notch 54 of the third tier groupings 46 (see FIGS. 6 and 7). FIG. 7 shows one third tier grouping 46 united with four units 70 (assembly is inverted). Note that each of the units 70 can rock freely on the lever arms 44 of grouping 46 within the notch 54. The assembly in FIG. 7 represents the structure found under one quadrant I, II, III or IV of one cushion 10.

Figure 9:
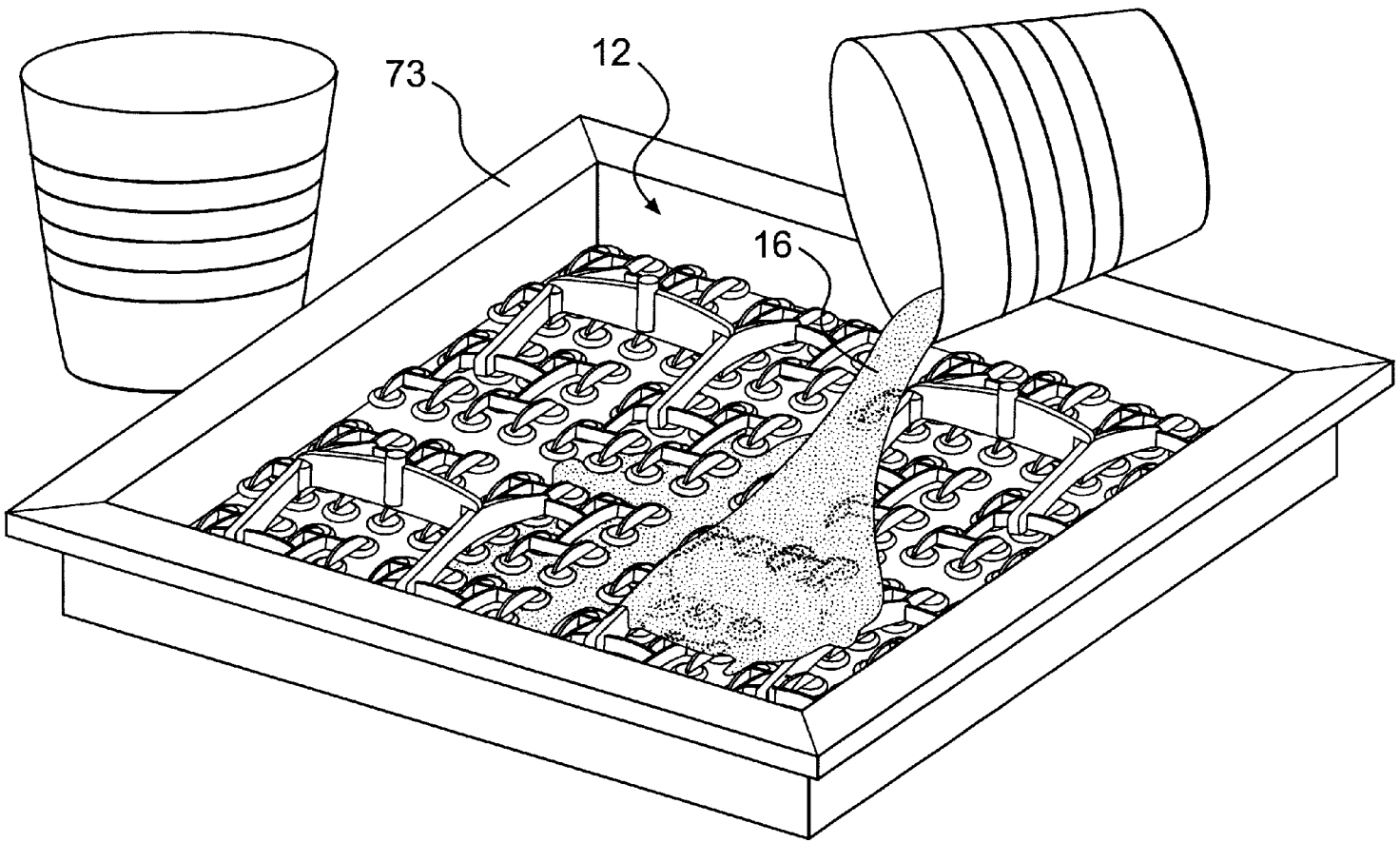
FIG. 9 is a photographic representation showing the foam filing mixture being poured into the form over the outer foam cover and on the mechanical support structure.

As discussed above, the support posts 54 and levers 30, 36, 44 preferably are molded plastic parts. This construction of the molded plastic parts allows for relatively easy and fast manufacturing and assembly of the cushion 10. To assemble the cushion 10, a preformed soft foam shell 15, preferably ½ inch thick, is placed in a form or mold 73 having interior dimensions of 16.5×16.5×3 inches, as shown in FIG. 8. This shell 15 becomes the outer surface of the finished cushion 10 (FIG. 10). Sixteen units 70 then are arranged on the foam, and four third tier groupings 46 are placed on the units 70 as shown in FIGS. 8 and 9. The liquid components that produce a low density soft urethane foam filing 16 are quickly mixed and poured into the form 73 (FIG. 9). The 13×13×3/16 inch plywood panel 64 is quickly placed over the four support posts 54 of the third tier groupings 46 to form a relatively stiff bottom that will rest on the wheelchair seat. The mixture for filing 16 quickly foams up and around all of the parts and sets relatively quickly. Once the foam filing 16 cures, the cushion 10 is removed from the form 73. Excess foam is trimmed to form a smooth bottom and the cushion 10 assembly is finished (FIG. 10). Foam filing 16 used in the preferred embodiment is IPI International, Inc. ISOFORM® F-1474-026F-1474-026F Polyurethane Flexible Foam System.

Theoretically, it is expected that a lever support system as shown schematically in FIG. 3, would require equal forces on all support points and therefore equal pressure throughout the support surface. However, in practice, two sources of elasticity in the cushion 10 cause some variation in pressures that are measured. While the foam is very low in density and soft, it does have some resistance to deformation and, in addition, the plastic elements, while being very flexible, do elastically resist deformation to a certain extent. These two elastic resistances to deformation have some effect on the overall action of the cushion 10. The main support pressure is obtained from the lever action that has been presented and tends toward that pressure that results from the weight divided by the area of support in contact with the body, but this pressure is altered somewhat by the effects of the elastic deformations described. Furthermore, the 4-point support system of the cushion 10 creates four separate support quadrants I, II, III and IV. The position of the body center of gravity, as affected by torso position and footrest position, changes the average pressures in each quadrant depending on how much of the body weight that quadrant is required to support. Thus, the cushion design of the present invention provides improved support for a wheelchair user, is relatively inexpensive to manufacture and is durable and reliable in operation.

Figure 11:
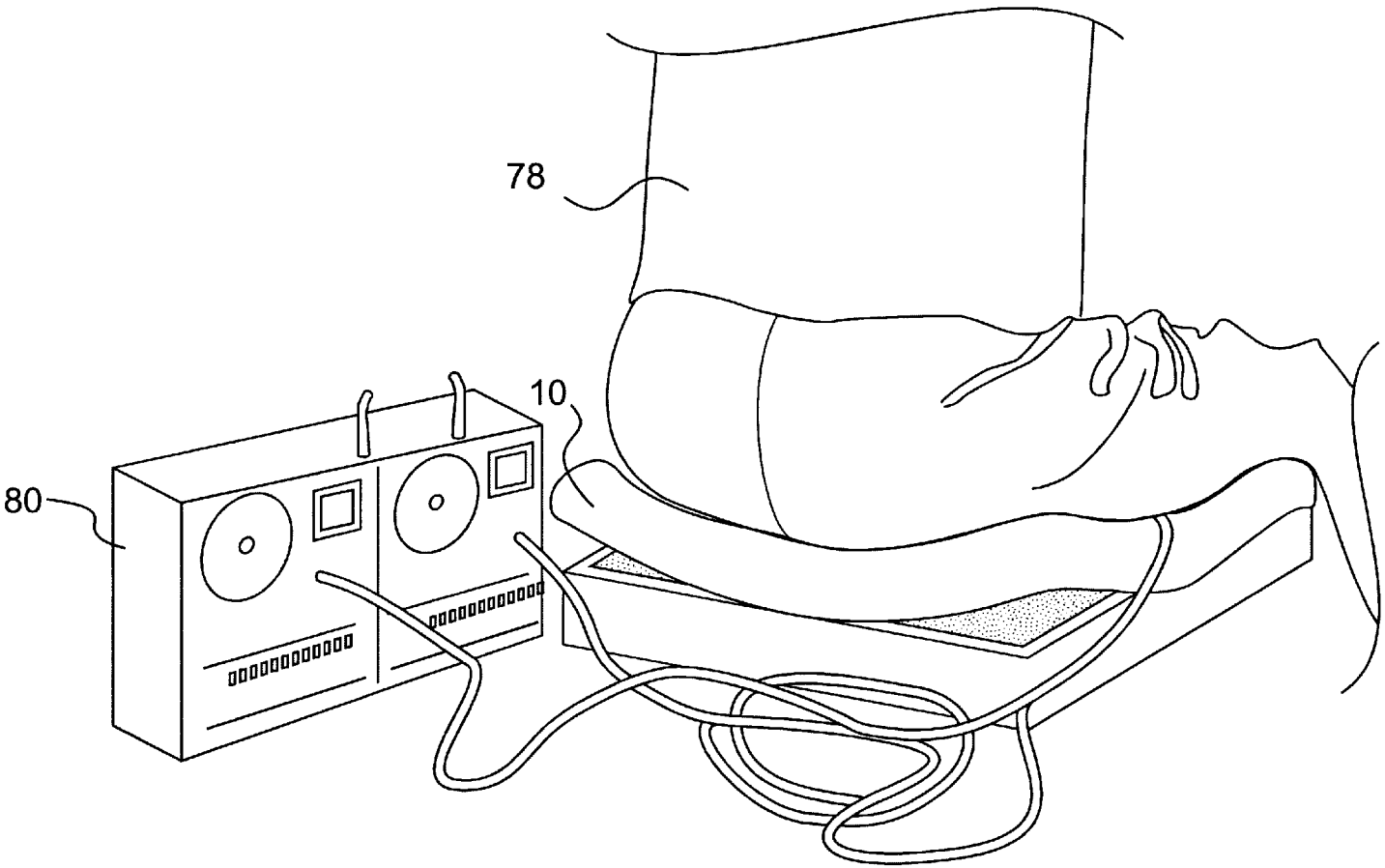
FIG. 11 is a photographic representation showing a user seated on the support cushion, with Gaymar pressure measurement system used to measure sitting pressures.
Figure 12:
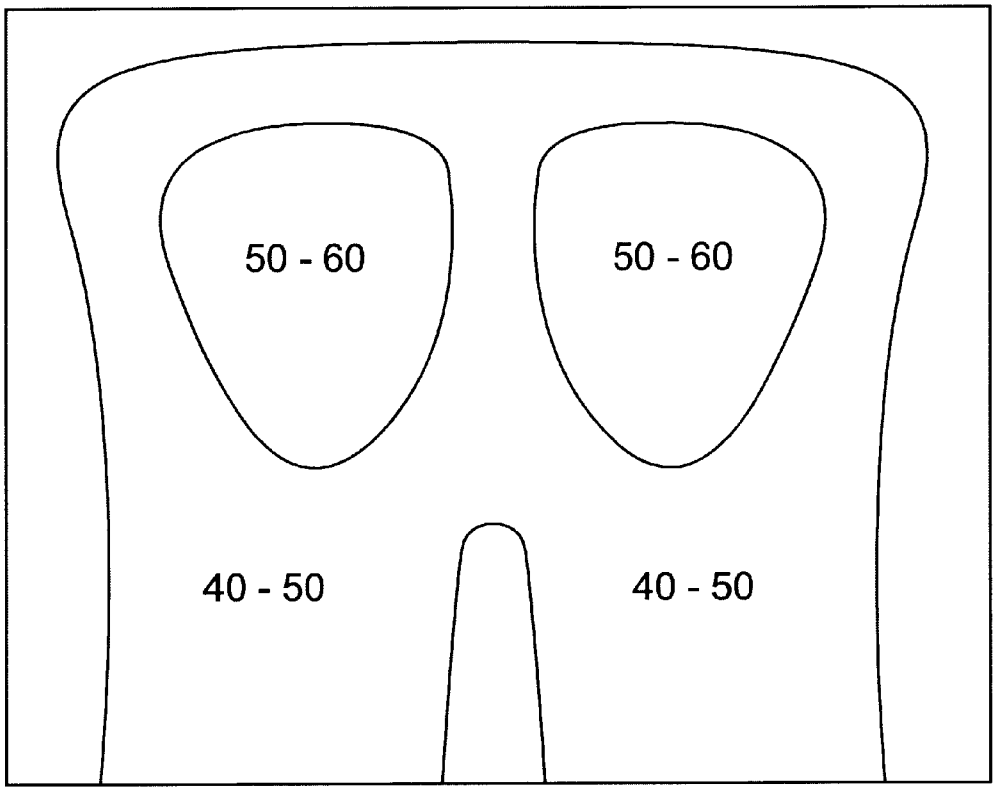
FIG. 12 is a schematic drawing of approximate pressure areas in mmHg as measured at selected points with Gaymar pressure measuring instruments.

Rudimentary measurements were performed on a female subject 78 using a pair of Gaymar pressure measuring devices 80. FIG. 11 shows this experimental setup. FIG. 12 shows approximate pressure distributions that were measured (in mmHg) when she maintained an erect position with minimal floor support of her legs.

The support cushion 10 of the present invention also finds application in ergonomic chairs that provide improved comfort and health to persons who must sit for long times as, for example, when working at a computer. A seat incorporating the mechanical support structure 12 and foam cushioning 14 permits individual forward and backward rocking of each thigh and provides degrees of freedom that are not found in a conventional office chair. Rocking of the seat and thighs provides additional comfort, induces good sitting posture, especially when working without touching the back rest and may enhance the movement of fluids in the low back vertebrae. This degree of freedom can be produced by adding two additional levers to the design of the wheelchair cushion so that each of the two support points on either side are supported by levers that can rock at their midpoints. Thus, the 4-point support of the wheelchair cushion is changed to a 2-point support for an ergonomic chair seat.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A method for making a support cushion, comprising the steps of:

placing a preformed foam shell having a top panel and sidewalls extending downwardly therefrom in a form having dimensions slightly greater than the peripheral dimensions of the top panel;

placing a mechanical support structure on the top panel of the foam shell in a cavity defined by the top panel and sidewalls;

pouring a foam filling mixture in the cavity of the outer shell so that the mechanical support structure is imbedded in the foam filling after the foam filing cures;

placing a bottom panel over the mechanical support before the foam filling cures; and removing the cushion from the form after the foam filling cures.

2. A support, comprising:

upper and lower support surfaces;

a three dimensional lever system having multiple tiers, each tier having associated groupings of laterally and transversely extending lever arms disposed in "H" configurations;

a bottom one of said tiers being supported on the bottom support surface and each said grouping of said lever arms disposed in an "H" configuration of a top one of said tiers having free ends supporting discrete support points establishing the upper support surface of said support;

each said tier other than said top tier having notches at free ends of said lever arms in which middle levers of the associated "H" shaped groupings of lever arms of an adjacent upper tier are respectively supported; and a form filling embedding the three dimensional lever system wherein said foam filling retains the middle levers in position in the corresponding notches without being subject to overall compression by a load supported on the upper support surface.

3. A support according to claim 2, wherein said three dimensional lever system includes three tiers and said support is a cushion.

4. A support according to claim 3, wherein said levers of said three dimensional lever system are molded plastic levers.

5. A wheel chain seat support, comprising:

an upper support surface on which a wheelchair user is to be supported;

a bottom support that is to be supported by a wheelchair;

a three dimensional lever system having multiple tiers, each tier having associated groupings of laterally and transversely extending lever arms disposed in "H" configurations between said bottom and said top support surfaces;

a bottom one of said tiers being supported on the bottom support and each said grouping of said lever arms disposed in an "H" configuration of a top one of said tiers having free ends supporting a plurality of discrete support points, one at each end of each of said levers that establish the upper support surface of said support;

each said tier other than said top tier having notches at free ends of said lever arms in which middle levers of the associated "H" shaped groupings of lever arms of an adjacent upper tier are respectively supported; and a foam filling between said upper support surface and said bottom support that embeds the three dimensional lever system, wherein said foam filling retains the middle levers in position in the corresponding notches without being subject to overall compression by a load supported on the upper support surface.

6. A wheelchair seat support according to claim 5, wherein said wheelchair seat support is a cushion.

7. A wheelchair seat support according to claim 6, wherein said levers of said three dimensional lever system are molded plastic levers.

8. A wheelchair seat support according to claim 6, wherein said bottom one of said tiers of said lever arms has four support points that engage said bottom support and further wherein said plurality of discrete support points are buttons.

9. A wheelchair seat support according to claim 8, wherein said levers of said three dimensional lever system and said buttons are made of molded plastic.

10. A wheelchair seat support according to claim 5, wherein said wheelchair seat support is a cushion and said bottom support is a rigid bottom panel of the cushion, wherein said bottom one of said tiers of said lever arms has four support points that engage said rigid bottom panel to provide a stable support platform for a wheelchair user.

* * * * *